US009592550B2

(12) United States Patent
Kawabata et al.

(10) Patent No.: US 9,592,550 B2
(45) Date of Patent: Mar. 14, 2017

(54) METHOD FOR PRODUCING CASTINGS

(71) Applicant: HITACHI METALS, LTD., Tokyo (JP)

(72) Inventors: Masahide Kawabata, Moka (JP); Lin Wang, Moka (JP); Yoshimasa Fujii, Moka (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 14/899,688

(22) PCT Filed: Jun. 19, 2014

(86) PCT No.: PCT/JP2014/066287
§ 371 (c)(1),
(2) Date: Dec. 18, 2015

(87) PCT Pub. No.: WO2014/203966
PCT Pub. Date: Dec. 24, 2014

(65) Prior Publication Data

US 2016/0144425 A1 May 26, 2016

(30) Foreign Application Priority Data

Jun. 20, 2013 (JP) ..... 2013-129325
Mar. 14, 2014 (JP) ..... 2014-051242

(51) Int. Cl.
*B22D 18/04* (2006.01)
*B22D 27/09* (2006.01)
*B22D 27/04* (2006.01)

(52) U.S. Cl.
CPC ..... *B22D 18/04* (2013.01); *B22D 27/04* (2013.01); *B22D 27/09* (2013.01)

(58) Field of Classification Search
CPC ..... B22D 18/04; B22D 27/04; B22D 27/09
(Continued)

(56) References Cited

U.S. PATENT DOCUMENTS 5,263,532 A * 11/1993 Kawaguchi ..... B22D 27/04 164/155.6
5,954,113 A * 9/1999 Buchborn ..... B22C 9/082 164/120

(Continued)

FOREIGN PATENT DOCUMENTS

JP 2007-075862 A 3/2007
JP 2010-269345 A 12/2010

OTHER PUBLICATIONS

International Search Report of PCT/JP2014/066287 dated Jul. 15, 2014 [PCT/ISA/210].

*Primary Examiner* — Kevin E Yoon
(74) *Attorney, Agent, or Firm* — Sughrue Mion, PLLC

(57) ABSTRACT

A method for producing a casting by pouring a metal melt by gravity into a gas-permeable casting mold 1 having a cavity comprising at least a sprue 6, a runner 7 and a product-forming cavity 9, comprising pouring a metal melt into a desired cavity portion 10 including the product-forming cavity through the sprue, the melt being in a volume substantially equal to the volume of the desired cavity portion; supplying a gas 14 to the desired cavity portion through the sprue before the desired cavity portion is filled with the poured melt, so that the melt fills the desired cavity portion; and cooling a portion of the melt in contact with the gas directly or indirectly by water 16 supplied from outside the gas-permeable casting mold, simultaneously with, during or after supplying the gas, thereby solidifying the melt.

10 Claims, 6 Drawing Sheets

(58) Field of Classification Search
USPC ..... 164/119, 120, 126, 128
See application file for complete search history.

(56) References Cited

U.S. PATENT DOCUMENTS 6,666,254 B2 * 12/2003 Voigt ..... B22C 9/103
164/119
2009/0151887 A1 6/2009 Goka

* cited by examiner

METHOD FOR PRODUCING CASTINGS

CROSS REFERENCE TO RELATED APPLICATIONS

This application is a National Stage of International Application No. PCT/JP2014/066287, filed Jun. 19, 2014 (claiming priorities based on Japanese Patent Application Nos. 2013-129325, filed Jun. 20, 2013 and 2014-051242, filed Mar. 14, 2014), the contents of which are incorporated herein by reference in their entirety.

FIELD OF THE INVENTION

The present invention relates to a method for producing desired castings by a gas-permeable casting mold.

BACKGROUND OF THE INVENTION

To produce castings by gravity pouring, a casting mold composed of sand particles, which is a gas-permeable casting mold (a so-called sand mold), is most generally used. With such a gas-permeable casting mold, a gas (generally air) remaining in a cavity of a particular shape is pushed out of the cavity by a metal melt (simply called "melt"), and the melt is formed into a casting having substantially the same shape as the cavity. The cavity of the casting mold generally includes a sprue, a runner, a feeder and a product-forming cavity, into which a melt is supplied in this order. When a melt head in the sprue becomes high enough to fill a product-forming cavity, the pouring of the melt is finished.

A solidified melt forms a casting integrally extending from the sprue to the runner, the feeder and the product-forming cavity. The feeder is not an unnecessary portion for obtaining good castings, while the sprue and the runner are merely paths for a melt to reach the product-forming cavity, which need not be filled with the melt. Thus, as long as a melt is solidified in a state of filling the sprue and the runner, drastic improvement in a pouring yield cannot be expected. In the case of castings integrally having unnecessary portions, considerable numbers of steps are needed to separate cast products from unnecessary portions, resulting in low production efficiency. Accordingly, the sprue and the runner pose large problems in increasing efficiency in gravity casting.

A revolutionary method for solving the above problems is proposed by JP 2007-75862 A and JP 2010-269345 A. To fill a desired cavity portion, part of a cavity in a gas-permeable casting mold, this method pours a metal melt in a volume smaller than that of an entire cavity in a gas-permeable casting mold (hereinafter referred to as "casting mold cavity"and substantially equal to that of the desired cavity portion, into the cavity by gravity; supplies a gas (compressed gas) into the cavity through a sprue before the melt fills the desired cavity portion; and then solidifies the melt filling the desired cavity portion. By this method commonly disclosed in JP 2007-75862 A and JP 2010-269345 A, which may be called "pressure-casting method," it is expected to make it substantially unnecessary to fill a sprue and a runner with a melt, because pressure to be obtained by the melt head height is given by the compressed gas.

As a result of experiment to follow the pressure-casting method described in JP 2007-75862 A and JP 2010-269345 A, the inventors have found that because a melt filling the cavity under gas pressure flows reversely when the supply of the gas is stopped, the supply of the gas should be continued until part of the melt in contact with the gas is solidified, though the entire melt need not be solidified, to obtain sound castings. However, it takes much time until a portion of the melt in contact with the gas is solidified to stop the reverse flow of the melt. Accordingly, an additional means for preventing the reverse flow of the melt to keep the melt to fill the cavity is necessary to shorten a production tact in such method.

As such additional means, JP 2007-75862 A and JP 2010-269345 A disclose various methods, such as a method of supplying a cooling gas to a portion of the melt in contact with the gas to accelerate the solidification of the melt, a method of mechanically shutting the cavity, a method of filling refractory particles, and a method of introducing a metal to accelerate the solidification of the melt by the latent heat of melting the metal. Though any of them are effective, for example, the method of supplying a cooling gas may suffer a problem that the melt is not solidified within a desired time, because of insufficient heat capacity of the cooling gas depending on the size of a casting. A method of mechanically sealing a melt by a shutter plate projecting into a runner from a recess open on an upper mold surface above the runner is also disclosed. In this method, however, the shutter plate should be provided in every casting mold, suffering cost increase. Thus desired is a simpler means capable of exhibiting sufficient effects.

OBJECT OF THE INVENTION

Accordingly, an object of the present invention is to provide a method for producing a casting by pressure casting, by which a melt can be easily kept filling a cavity by a gas supplied.

DISCLOSURE OF THE INVENTION

As a result of intensive research in view of the above object, the inventors have found that in a method for producing a casting by pouring a metal melt into a gas-permeable casting mold, a portion of the melt in contact with a gas supplied to charge the melt into a desired cavity portion can be cooled by water for rapid solidification, so that the melt is easily kept filling the desired cavity portion. The present invention has been completed based on such finding.

Thus, the method of the present invention for producing a casting by pouring a metal melt by gravity into a gas-permeable casting mold having a cavity comprising at least a sprue, a runner and a product-forming cavity, comprises pouring a metal melt into a desired cavity portion including the product-forming cavity through the sprue, the melt being in a volume smaller than the volume of an entire cavity of the gas-permeable casting mold and substantially equal to the volume of the desired cavity portion;

supplying a gas to the desired cavity portion through the sprue before the desired cavity portion is filled with the poured melt, so that the melt fills the desired cavity portion; and cooling a portion of the melt in contact with the gas directly or indirectly by water supplied from outside the gas-permeable casting mold, simultaneously with, during or after supplying the gas, thereby solidifying the melt.

The melt is preferably solidified by bringing water into contact with a portion of the melt in contact with the gas.

The water is preferably supplied in the form of a mist-containing gas.

A hollow portion of the product-forming cavity preferably spreads above its melt inlet.

The cavity of the gas-permeable casting mold preferably comprises a feeder disposed between the product-forming cavity and the runner and constituting the desired cavity portion together with the product-forming cavity, a hollow portion of the feeder spreading above its melt inlet.

The water is preferably supplied to part of the desired cavity portion having a portion of the melt in contact with the gas, through a supply hole formed at a different position from that of the sprue.

The supply hole is preferably a bottomed hole.

A bottom surface of the supply hole preferably opposes a cavity portion comprising a portion of the melt in contact with the gas, via part of the gas-permeable casting mold.

There is preferably a cooling member between the bottom surface of the supply hole and the cavity portion having a portion of the melt in contact with the gas.

The melt is preferably cooled by the water for solidification, while part of the gas-permeable casting mold or the cooling member between the bottom surface of the supply hole and a cavity portion comprising a portion of the melt in contact with the gas is pushed to a portion of the melt in contact with the gas.

BRIEF DESCRIPTION OF THE DRAWINGS

FIG. 1(*b*) is a schematic view showing a stage of the first production method of the present invention in which a desired cavity portion is being filled with a melt under gas pressure.

FIG. 1(*c*) is a schematic view showing a stage of the first production method of the present invention in which water is supplied to a rear end portion of the poured melt.

FIG. 1(*d*) is a schematic view showing a stage of the first production method of the present invention in which a melt is cooled with the supplied water.

FIG. 5(*b*) is a schematic view showing a stage of the third production method of the present invention in which a desired cavity portion is being filled with a melt under gas pressure.

FIG. 5(*c*) is a schematic view showing a stage of the third production method of the present invention in which water is supplied to cool a melt.

DESCRIPTION OF THE PREFERRED EMBODIMENTS

Figure 1A:
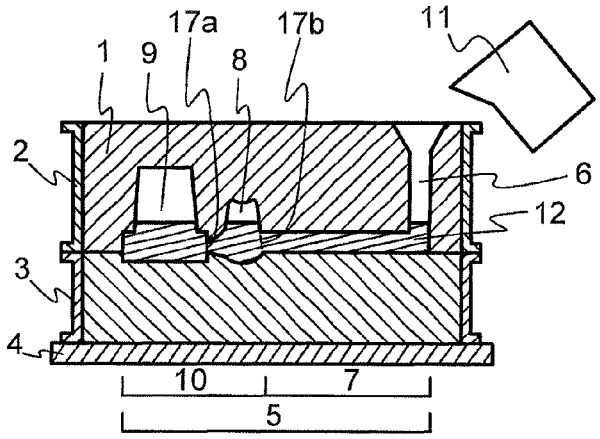
FIG. 1(*a*) is a schematic view showing a stage of the first production method of the present invention immediately after a melt is poured.
Figure 1B:
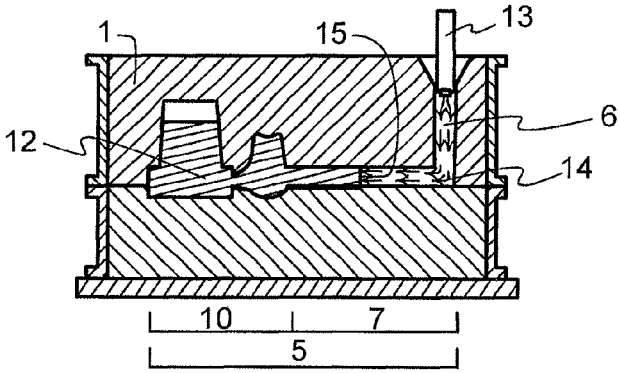
Figure 1C:
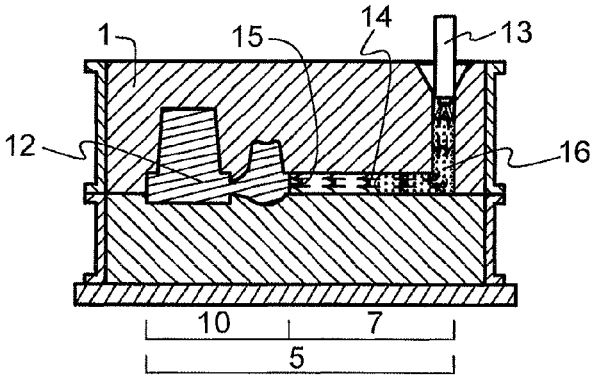
Figure 1D:
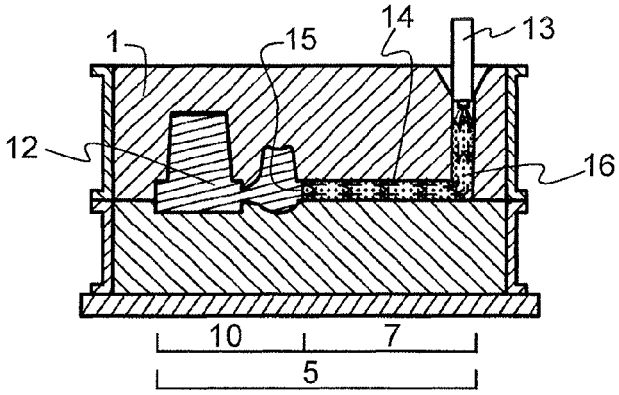

The method of present invention for producing a casting by pouring a metal melt by gravity into a gas-permeable casting mold having a cavity comprising at least a sprue, a runner and a product-forming cavity, comprises pouring a metal melt into a desired cavity portion including the product-forming cavity through the sprue, the melt being in a volume smaller than the volume of an entire cavity of the casting mold and substantially equal to the volume of the desired cavity portion;

supplying a gas to the desired cavity portion through the sprue before the desired cavity portion is filled with the poured melt, so that the melt fills the desired cavity portion; and cooling a portion of the melt in contact with the gas directly or indirectly by water supplied from outside the gas-permeable casting mold, simultaneously with, during or after supplying the gas, thereby solidifying the melt.

The cavity of the gas-permeable casting mold may be provided with a feeder, if necessary. In this case, the desired cavity portion includes the product-forming cavity and the feeder.

The term "a portion of the melt in contact with the gas" means a surface portion and its vicinity of a melt poured into a casting mold cavity, which comes into contact with a gas supplied through a sprue. Specifically, it means a portion of a melt charged into a desired cavity portion with a gas supplied, which is solidified by cooling with water supplied from outside the casting mold, thereby forming a plug preventing the reverse flow of the melt toward the sprue in an opposite direction to that of the gas flow. This portion corresponds to a rear end portion of the melt charged into the desired cavity portion by the gas.

One of the important features of the present invention is that simultaneously with, during or after supplying the gas, a portion of the melt in contact with the gas (a rear end portion of the melt) is cooled directly or indirectly by water supplied from outside the gas-permeable casting mold, thereby cooling the rear end portion of the melt faster than a melt body inside the product-forming cavity. The present invention can thus exhibit effects described below.

Water having larger heat capacity and latent heat of vaporization than those of other gases and liquids exhibits higher cooling capability, thereby shortening the solidification time of a portion of the melt in contact with the gas, namely, a rear end portion of the melt (sprue-side end portion), resulting in a shorter time period until the reverse flow of the melt is prevented after starting the supply of the gas. Because water is vaporized to steam having a larger volume, it can supplement the gas pressure. Because steam can rapidly escape from the cavity in a gas-permeable casting mold used in the present invention, water can be newly supplied, resulting in remarkably efficient cooling. To have such higher cooling capability of water, water is desirably brought into contact with a portion of the melt in contact with the gas, to solidify the melt. With water brought into contact with a portion of the melt in contact with the gas, heat can be rapidly removed from the rear end portion of the melt for directly cooling.

Such high cooling capability is effective to reduce the thermal deterioration of silica sand particularly in a runner, etc., for example, in a green sand mold obtained by blending silica sand with clay as a binder, and water, etc. Also, because a green sand is usually used repeatedly after removing a solidified cast product from the green sand mold, water is given for cooling during sending the green sand in a mold-forming step, or water is given together with clay, etc. to adjust a binding force in blending the green sand with other components. Accordingly, water is not a harmful foreign matter in such a sand-recycling step, contributing to the stabilization of product quality and the suppression of production cost. When a casting mold is a green sand mold, a melt poured into the casting mold can be cooled by water contained in the green sand mold, but it should be noted that the present invention positively supplies water to cool a portion of the melt in contact with the gas from outside the casting mold, differently from using water in the green sand mold.

In the present invention, cooling by water is carried out simultaneously with, during or after supplying the gas, similarly effectively with high cooling capability. The preferred embodiments will be explained in detail below.

A method of conducting water cooling simultaneously with supplying the gas is suitable in a case free from a trouble that the poured melt is solidified before filling the desired cavity portion, thereby clogging the runner. It is particularly suitable to increase cooling capability, for example, in the production of a large product with a thick-runner design.

A method of conducting water cooling after supplying the gas is suitable, in a case where the melt is solidified by the gas to some extent, so that the reverse flow of a melt being cooled unlikely occurs after stopping the supply of the gas. It is particularly suitable to shorten a production tact by sure solidification of the melt, for example, in the production of a small product with a thin-runner design.

A method of conducting water cooling during supplying the gas is advantageous in that because only the gas is supplied at an early stage, the poured melt is pressurized without rapid solidification, so that it is rapidly charged into the desired cavity portion. By subsequent water cooling while supplying the gas, the rapidly solidification of the melt can be started. In the present invention, water cooling is more preferably conducted during supplying the gas, from these aspects.

When water cooling is conducted simultaneously with or during supplying the gas, the volume-expanded steam of the supplied water adds increased pressure to the pressure of the supplied gas, so that the melt is faster charged into the desired cavity portion, more surely keeping the melt charged.

Though water may be in the form of water stream, shower, etc. in the present invention, it is preferable to supply water in the form of mist, from the aspect of preventing the explosive boil of water, controlling the amount of water, and an easy combination with the gas.

Mist can be formed by various means. For example, a spray nozzle such as a two-fluid nozzle capable of easily forming fine particles, a means of utilizing the Venturi effect in a carburetor or a spray, etc. can be used. When the supply of mist starts during supplying the gas, mist is sent to a gas pipe at predetermined timing from a spray nozzle, etc. open in the gas pipe. With mist generated in a gas pipe, the pouring of a melt and the supply of a gas and mist can be rapidly conducted, simply by connecting the gas pipe to the casting mold. When mist is formed by a means utilizing the Venturi effect, a water pipe need only be connected to the gas pipe, resulting in a simple structure.

The basic technology of the present invention will be explained below. The present invention utilizes the basic technology of producing castings by a gas-pressure-casting method, which is proposed by JP 2007-75862 A and JP 2010-269345 A, though not restricted to the disclosures of these references.

The gas-permeable casting mold is generally a green sand mold, a shell mold, a self-hardening mold, or any other casting mold composed of sand particles for having a certain level of gas permeability uniformly. The casting mold may be formed by ceramic or metal particles in place of sand particles. Materials having no gas permeability, such as gypsum, can be used to obtain a gas-permeable casting mold, by adding or partially using gas-permeable materials for sufficient gas permeability. Even a casting mold having no gas permeability at all, such as a metal die, may be used as a gas-permeable casting mold, when vents such as vent holes for gas permeability are added.

In the present invention, a melt in a volume smaller than the entire volume of the casting mold cavity, and substantially equal to the volume of the desired cavity portion including the product-forming cavity is poured by gravity. The volume of the poured melt is limited, because the pouring of a melt in a volume completely filling the casting mold cavity would fail to achieve improved yield. In a gravity-casting method using a conventional gas-permeable casting mold, an entire cavity including a product-forming cavity should be filled with a melt, to obtain a good product, resulting in a pouring yield of at most about 70%, with no expectation of a drastically higher yield. On the other hand, using the basic technology of the present invention, a pouring yield of about 100% can be theoretically expected.

In a cavity structure in which a poured melt spontaneously fills a desired cavity portion, a gas need not be supplied. However, in the case of pouring a melt in a volume substantially equal to that of a desired cavity portion including a product-forming cavity (if necessary, a runner) as in the present invention, a gas should be supplied through a sprue before the desired cavity portion is filled with the poured melt, so that the melt fills the desired cavity portion and is solidified.

The gas supplied to cause the melt to fill the desired cavity portion may be air from the aspect of cost, or a non-oxidizing gas such as argon, nitrogen, carbon dioxide, etc. from the aspect of preventing the oxidation of the melt. Though the gas may be supplied with a fan, a blower, etc., it is preferable to use a compressor, etc., because it can uniformly pressurize the melt.

In addition to the above basic technology, the present invention has two embodiments of supplying a gas and water to a portion of the melt in contact with the gas.

(1) An embodiment of supplying both gas and water through the same path (specifically sprue and runner)

(2) An embodiment of supplying a gas through a sprue, and water through another path (specifically, supply hole formed at a different position from that of a sprue)

Each of these embodiments has two examples of cooling a portion of the melt in contact with the gas.

(*a*) Direct cooling with water (*b*) Indirect cooling with water

Their combinations will be explained below by the first to eighth embodiments. Among combinations of the methods of supplying a gas and water with the cooling methods, an embodiment of supplying both gas and water through the same path to directly cool a portion of the melt in contact with the gas by water [combination of the embodiment (1) and the embodiment (*a*)] will be explained below as the first embodiment.

Further, among combinations of the methods of supplying a gas and water with the cooling methods, an embodiment of supplying both gas and water through the same path to indirectly cool a portion of the melt in contact with the gas by water [combination of the embodiment (1) and the embodiment (*b*)] will be explained below as the second embodiment.

First Embodiment

A casting method in the first embodiment, in which water cooling is conducted during supplying a gas, will be explained below referring to the attached drawings. FIGS. 1(*a*) to 1(*d*) show an example of production steps in the first embodiment. Constituents in the production method described below are not restricted to the first embodiment, but may be properly combined with those in other embodiments (second to eighth embodiments), as long as the effects of the present invention are obtained. Likewise, constituents explained in each embodiment below (second to eighth embodiments) may be properly combined with those in other embodiments.

The casting mold 1 is a gas-permeable casting mold using green sand, which is placed on a bottom board 4 with an upper flask 2 and a lower flask 3 combined, as shown in FIGS. 1(*a*) to 1(*d*). A casting mold cavity 5 comprises a sprue 6, a runner 7, a feeder 8, and a product-forming cavity 9, the product-forming cavity 9 and the feeder 8 constituting a desired cavity portion 10. Though the feeder 8 is contained in this embodiment, the feeder 8 may be omitted, if unnecessary.

FIG. 1(*a*) shows a stage immediately after a melt 12 in a volume substantially equal to that of the desired cavity portion 10 is poured from a ladle 11 to the sprue 6 of the casting mold 1 (pouring step).

As shown in FIG. 1(*b*), an ejection device 13 capable of ejecting a gas and water separately or together is inserted into the sprue 6, and a gas 14 is supplied from the ejection device 13 to the casting mold cavity 5 before the solidification of the melt 12 starts (the flow of the gas is indicated by pluralities of arrows). By this operation, a melt portion 15 of the melt 12 in contact with the gas 14, which may be called simply "melt portion," is pushed by the gas 14 toward the desired cavity portion 10, so that the melt 12 is charged into the desired cavity portion 10 (pressurizing step).

As shown in FIG. 1(*c*), water 16 (shown by pluralities of dots) is supplied from the ejection device 13 while supplying the gas 14. Water 16 is preferably in the form of mist, fine droplets, such that it can be easily conveyed by the flow of the gas 14. The timing of ejecting water 16 from the ejection device 13 is properly adjusted, such that water 16 reaches the melt portion 15 of the melt 12 in contact with the gas 14, after the desired cavity portion 10 is filled with the melt 12. By this operation, the melt 12 is pressurized without rapid solidification until water 16 reaches the melt portion 15 of the melt 12 in contact with the gas 14, so that the poured melt 12 can be rapidly charged into the desired cavity portion 10 (water-supplying step).

As shown in FIG. 1(*d*), the ejected water 16 then comes into contact with the melt portion 15 of the melt 12 in contact with the gas 14, so that the cooling of the melt is accelerated by direct contact with water 16, resulting in rapid solidification of the melt 12 filling the desired cavity portion 10 while preventing its reverse flow (cooling step).

With water 16 thus supplied while supplying the gas 14, the melt 12 can be rapidly charged into the desired cavity portion 10 and surely solidified, without the reverse flow of the charged melt 12 against the gas flow.

Particularly when a hollow portion of the product-forming cavity 9 spreads above its melt inlet 17*a*, and/or when a hollow portion of the feeder 8 spreads above its melt inlet 17*b*, as shown in FIG. 1(*a*), the present invention exhibits larger effects, because a melt filling the product-forming cavity 9 or the feeder 8 easily flows reversely through the inlet 17*a* or the inlet 17*b* under gravity.

Figure 2:
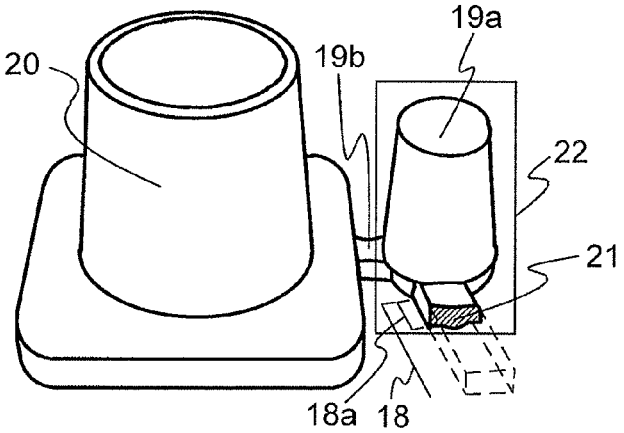
FIG. 2 is a schematic view showing an example of casting mold cavities used in the production method of the present invention.
Figure 3:
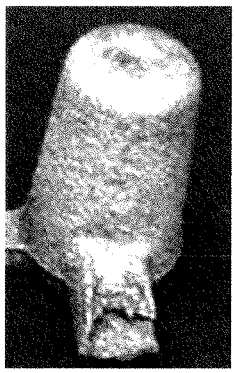
FIG. 3 is a photograph showing a feeder and part of a runner cast by the production method of the present invention.

The results of casting spheroidal graphite cast iron by the steps shown in FIGS. 1(*a*) to 1(*d*) according to the present invention are shown in FIGS. 2 and 3. As shown in FIG. 2, a casting mold cavity comprises a sprue (not shown), a runner 18 connected to the sprue, a feeder 19*a* connected to the runner 18, a feeder neck portion 19*b* connected to the feeder 19*a*, and a product-forming cavity 20 connected to the feeder neck portion 19*b*. A desired cavity portion, part of the casting mold cavity, is constituted by the product-forming cavity 20, the feeder 19*a*, the feeder neck portion 19*b*, and a portion 18*a* of the runner. According to the present invention, a portion 21 of the melt in contact with the gas does not flow reversely in the runner 18 toward the sprue (not shown), forming a cast portion corresponding to the portion 18*a* of the runner. FIG. 3 is a photograph showing a cast product 22 in the feeder 19*a* and the runner portion 18*a*.

Second Embodiment

Figure 4:
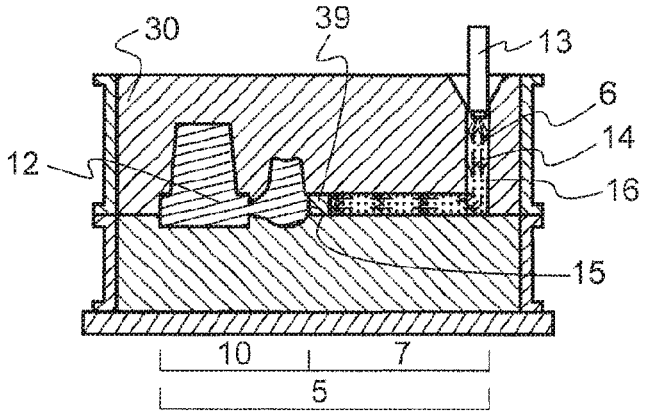
FIG. 4 is a schematic view showing a stage of the second production method of the present invention in which water is supplied to cool a melt.

Though the melt is directly cooled for solidification by bringing water (mist) into contact with a melt portion in contact with the gas (a rear end portion of the melt) in the first embodiment, a rear end portion of the melt may be indirectly cooled, for example, via a filler, etc. The specific embodiment (second embodiment) will be explained referring to FIG. 4 showing a melt-cooling step, like in FIG. 1(*d*). In FIG. 4, the same constituents as in the first embodiment are provided with the same reference numerals as in the first embodiment, and their detailed explanations will be omitted (as in other embodiments described below).

As shown in FIG. 4, the casting method in the second embodiment is the same as in the first embodiment, except that a filler 39 is disposed in the casting mold cavity 5, such that it is in contact with a melt portion 15 of the melt 12 in contact with the gas 14, namely, a sprue-side end portion of the melt 12, and that the melt portion 15 is indirectly cooled by the supplied water 16 via the filler 39. Because a rear end portion of the melt is indirectly cooled by water 16 via the filler 39 in this embodiment, the amount of water supplied should be optimized to exhibit the desired cooling capability, but it is possible to suppress explosive boil, which may occur by direct contact of the melt with water.

For example, the filler 39 can be introduced through the sprue 6 together with the gas 14 after the melt 12 is poured into the casting mold, so that it is conveyed by the gas 14 to a position coming into contact with an end portion of the melt 12. The filler 39 is preferably made of inorganic materials such as casting mold sand, ceramics, etc., or metals, as long as it has enough heat resistance to a high-temperature melt 12. It is particularly preferable to use a metal filler 39 having high thermal conductivity as cooling members. The filler 39 having the same composition as that of the melt 12 is more preferably used, because undesirable components do not enter the product. The filler 39 is not restricted to a block having a cross section corresponding to that of the runner 7 as shown in the figure, but pluralities of high-flowability particles, for example, may be introduced as the filler 39 into the runner 7.

In both casting methods in the first and second embodiments described above, the gas and water are supplied through the sprue and the runner, paths for flowing the melt. Though a portion of the melt in contact with the gas (a rear end portion of the melt) can be cooled by water even in the production method in this embodiment, water may be evaporated while flowing through the runner heated by the melt, for example, when the sprue and the runner are so long and bent that they have large resistance for water to reach a rear end portion of the melt, failing to exhibit sufficient cooling capability.

As a result of investigation, the inventors have found that though a gas should be supplied through the sprue to cause the melt to fill the desired cavity portion, water can be more preferably supplied through a different path from that of the gas, specifically, toward a cavity containing a portion of the melt in contact with the gas (this cavity may be called "gas-contacting portion" below), through a supply hole formed at a different position from that of the sprue, because water can surely be supplied to a rear end portion of the melt with suppressed evaporation, resulting in increased capability of cooling a rear end portion of the melt.

When water is supplied through a supply hole formed at a different position from that of the sprue, the supply of water through the sprue and the runner may or may not be combined. Production methods in the third to eighth embodiments will be explained below.

Third Embodiment

The production method in the third embodiment of the present invention will be explained referring to FIGS. 5(*a*) to 5(*c*) showing production steps. The third embodiment is a combination of the embodiment (2) and the embodiment (*b*), in which a gas is supplied through the sprue, while water is supplied through a different path (specifically, a supply hole formed at a different position from that of the sprue) [embodiment (2)], to cool a rear end portion of the melt indirectly [embodiment (*b*)]. Of course, as described in the first and second embodiments, the supply of both gas and water through the sprue to directly or indirectly cool a rear end portion of the melt may be combined (the same is true in the fourth to seventh embodiments).

In this embodiment, a desired cavity portion 100 includes not only a product-forming cavity 9 and a feeder 8, but also a left end portion 71 (opposite end portion to the sprue 6) of a runner 7 connected to the feeder 8. As shown in FIG. 5(*c*), the left end portion 71 of this runner 7 is a gas-contacting portion (cavity containing the melt portion 15 in contact with the supplied gas 14). Namely, when the melt 12 is charged into the desired cavity portion 100 by the supplied gas 14, the melt portion 15 in contact with the gas 14 exists in the gas-contacting portion 71.

Figure 5A:
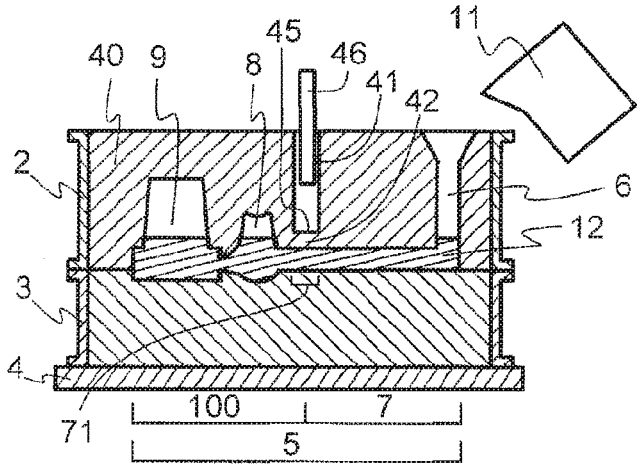
FIG. 5(*a*) is a schematic view showing a stage of the third production method of the present invention immediately after a melt is poured.
Figure 5B:
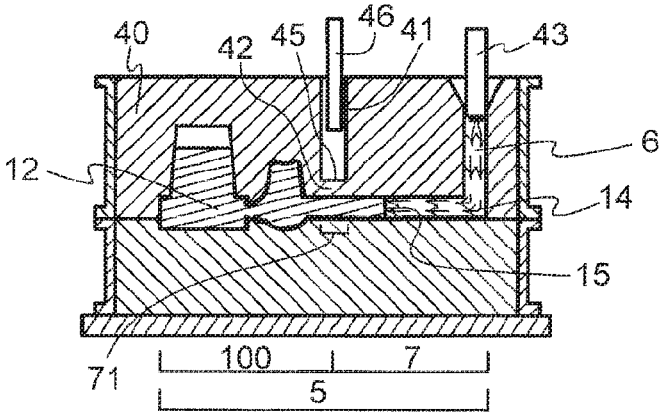
Figure 5C:
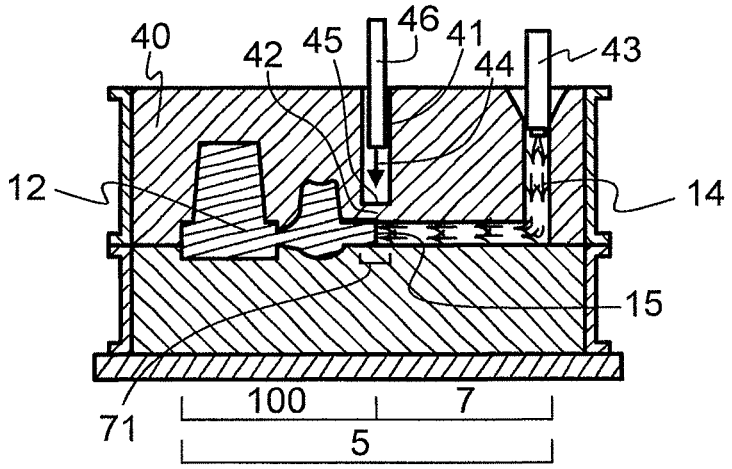

As shown in FIGS. 5(*a*)-5(*c*), a casting mold 40 used in the casting method in this embodiment has the same structure as that of the casting mold used in the casting method in the first embodiment, except that a supply hole 41 directed to the gas-contacting portion 71 is formed at a different position from that of the sprue 6. In the casting method in this embodiment using this casting mold 40, water 44 is supplied through the supply hole 41, and a gas 14 is supplied through the sprue 6 and the runner 7. Namely, a path (supply hole 41) for supplying water 44 is different from a path (sprue 6, and runner 7) for supplying a melt 12 and a gas 14.

Though a gas 14 for flowing the melt 12 is supplied through the sprue 6, while water 44 for cooling the melt portion 15 in contact with the gas 14 is supplied through the supply hole 41, in this embodiment as described above, the supply of water together with the gas 14 through the sprue 6 would be preferable, because of increased capability of cooling the melt portion 15 in contact with the gas 14. The supply of gas together with water 44 through the supply hole 41 is also preferable, because of efficient supply of water 44, and increased capability of cooling the melt portion 15 in contact with the gas 14. Incidentally, water is preferably supplied through a nozzle 46 of a water-supplying device introduced into the supply hole 41 through an upper opening thereof as shown in FIG. 5(*c*). The water-supplying device may be a well-known device.

The supply hole 41 for supplying water 44 will be explained in more detail. The supply hole 41 in this embodiment is a bottomed hole, which is formed by directly drilling the casting mold (green sand mold) 40 in an upper flask 2 to have a bottom surface 45. The supply hole 41 is a bottomed hole having inner and bottom surfaces on which the green sand mold is exposed, with its upper end (one end) open on an upper surface of the casting mold 40, and its lower end (the other end) as a bottom surface 45 opposing the gas-contacting portion 71. Such a supply hole 41 having a bottom surface 45 separate by a certain distance from the opposing gas-contacting portion 71 does not hinder the melt 12 from flowing through the runner 7, so that the melt 12 pushed by the gas 14 supplied through the sprue 6 is smoothly charged into the desired cavity portion 100.

As described above, the supply hole 41 in this embodiment is a substantially cylindrical, bottomed hole directly formed in the casting mold 40, though not restrictive. The supply hole may be, for example, a pipe member of an inorganic material or a metal embedded in the casting mold 40. However, drilling the casting mold 40 to form the supply hole 41 is industrially desirable from the aspect of cost. In this case, there remains a portion 42 of the casting mold 40 between the bottom surface 45 of the supply hole 41 and the gas-contacting portion 71 (cavity containing a rear end portion of the melt). When the supply hole 41 is formed by drilling the casting mold 40, a green sand mold, the inner and bottom surfaces, etc. of the supply hole 41 may be coated, for example, with a facing material, to keep the strength of the supply hole 41, thereby suppressing damage during handling. Further, the supply hole 41 need not exist above the gas-contacting portion 71, but need only have a bottom surface 45 opposing the gas-contacting portion 71.

A casting method using the casting mold 40 having the above structure in this embodiment will be explained. As shown in FIG. 5(*a*), a melt 12 in a volume substantially equal to the volume of the desired cavity portion is poured from a ladle 11 to the casting mold cavity 5 through the sprue 6 (pouring step).

As shown in FIG. 5(*b*), an ejection device 43 for ejecting a gas 14 is inserted into the sprue 6 to supply the gas 14 (shown by pluralities of arrows) to the casting mold cavity 5, before the solidification of the melt 12 starts. By this operation, the melt portion 15 in contact with the gas 14 is pushed by the gas 14 toward the desired cavity portion 100, so that the melt 12 flows through the runner 7 to fill the desired cavity portion 100 (pressurizing step).

As shown in FIG. 5(*c*), water 44 is ejected downward into the supply hole 41 from the nozzle 46 inserted into the supply hole 41, to cool the melt portion 15 in the gas-contacting portion 71. Specifically, water 44 supplied to the bottom surface 45 of the supply hole 41 comes into contact with a portion 42 of the casting mold 40 existing between the bottom surface 45 and the gas-contacting portion 71 (water-supplying step to cooling step).

A portion 42 of the casting mold 40 is heated by the melt 12 in the gas-contacting portion 71. Accordingly, water coming into contact with the portion 42 of the casting mold 40 is evaporated, thereby indirectly cooling the melt portion 15 via the portion 42 of the casting mold 40. Because the gas-permeable portion 42 of the casting mold (green sand mold) 40 also has high permeability of water 44, water 44 can penetrate the portion 42 of the casting mold 40 by properly adjusting the amount of water supplied, etc., so that water 44 can be brought into contact with the melt portion 15 in contact with the gas 14. Thus, not only indirect cooling but also direct cooling can be achieved through the gas-permeable (water-permeable) portion 42 of the casting mold 40 existing between the bottom surface 45 of the supply hole 41 and the gas-contacting portion 71, thereby surely cooling the melt portion 15 in contact with the gas 14.

The timing of cooling the melt portion 15 in contact with the gas 14 by water 44 is basically the same as in the casting method in the first embodiment described above. Thus, the cooling timing is not restricted, as long as it is simultaneously with, during or after supplying the gas 14, namely, after starting the supply of the gas 14. However, the melt 12 is preferably cooled by water 44 while supplying the gas 14, even after the desired cavity portion 100 is filled with the melt 12, because cooling by water 44 and cooling by the gas 14 occur simultaneously. Further, the cooling timing by water 44 is desirably adjusted properly, such that the desired cavity portion 100 is filled with the melt 12, before water 16 is brought into contact with the melt portion 15 in contact with the gas 14. By adjusting the cooling timing by water 44, the melt 12 is pressurized without rapid solidification until water 16 reaches the melt portion 15 in contact with the gas 14, so that the poured melt 12 can be rapidly charged into the desired cavity portion 100.

In the production method in this embodiment, water 44 is supplied to the gas-contacting portion 71 through the supply hole 41 formed at a different position from that of the sprue 6, so that the melt portion 15 in the gas-contacting portion 71 can be indirectly and preferably directly cooled, resulting in rapid solidification. As a result, the reverse flow of the melt 12 charged into the desired cavity portion 100 can be prevented.

Fourth Embodiment

Figure 6:
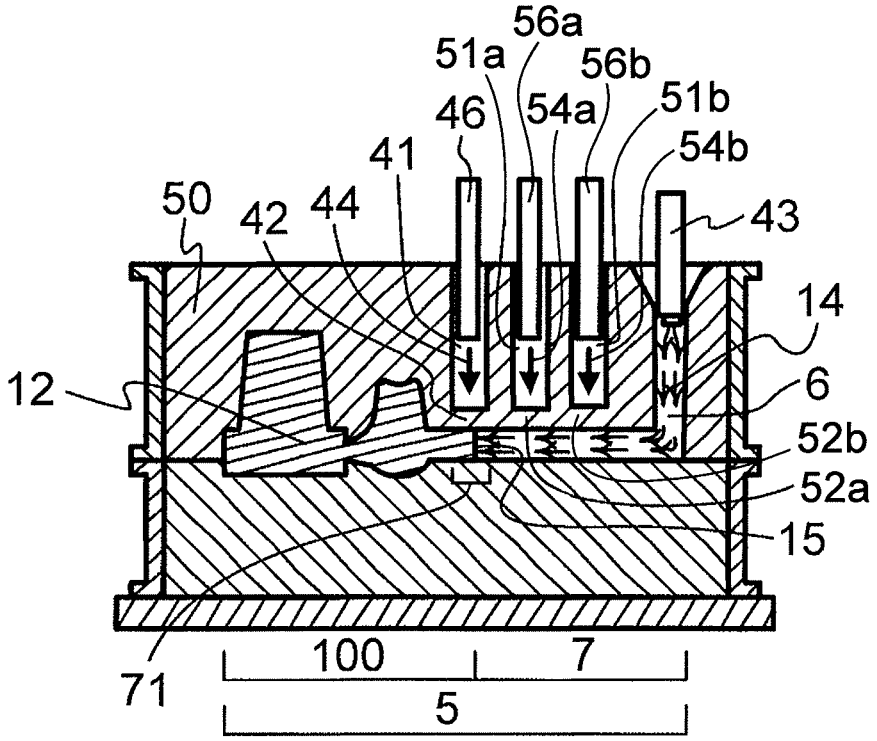
FIG. 6 is a schematic view showing a stage of the fourth production method of the present invention in which water is supplied to cool a melt.

A production method in the fourth embodiment of the present invention, which is more preferable than the third embodiment in cooling capability, will be explained referring to FIG. 6 showing the cooling step of a melt 12.

As shown in FIG. 6, the basic structure of a casting mold 50 used in the fourth embodiment is the same as in the third embodiment. Namely, the casting mold 50 used in this embodiment comprises, in addition to the same supply hole 41 directed to the gas-contacting portion 71 as in the third embodiment, which may be called "first supply hole" in this embodiment, two supply holes 51*a*, 51*b* disposed between the first supply hole 41 and a sprue 6 on the right side of the supply hole 41 for increasing cooling capability, which may be called "second supply hole 51*a*" and "third supply hole 51*b*," respectively. Except for the above components, the casting mold 50 in this embodiment is the same as the casting mold 40 in the third embodiment.

Like the first supply hole 41, each of the second and third supply holes 51*a*, 51*b* is a bottomed hole having a bottom surface directed to the runner 7 connected to a right side of the gas-contacting portion 71. Each nozzle 56*a*, 56*b* of a water-supplying device for supplying water 54*a*, 54*b* is inserted into each of the second and third supply holes 51*a*, 51*b*. The number of supply holes disposed between the first supply hole 41 and the sprue 6 need not be 2, but may be 1, or 3 or more. Like the supply hole 41 in the third embodiment, their shapes and positions are not restricted to those depicted.

The production method in the fourth embodiment comprises basically the same steps as in the third embodiment, including a pouring step to a cooling step. In the cooling step in this embodiment, too, the melt portion 15 in the gas-contacting portion 71 is cooled mainly by water supplied through the first supply hole 41, and auxiliarily by water 54*a*, 54*b* supplied through the second and third supply holes 51*a*, 51*b*. Specifically, water 54*a*, 54*b* supplied through the second and third supply holes 51*a*, 51*b* cools casting mold portions 52*a*, 52*b* between the runner 7 and the bottom surfaces of the second and third supply holes 51*a*, 51*b*, so that a gas 14 flowing through the runner 7 is indirectly cooled to accelerate the cooling of the melt portion 15. The portions 52*a*, 52*b* of the casting mold 50, a gas-permeable green sand mold, also have high permeability of water 54*a*, 54*b*. Accordingly, by properly adjusting the amount of water supplied, etc., water 54*a*, 54*b* entering the portions 52*a*, 52*b* of the casting mold 50 moves toward the melt portion 15 by the gas 14, thereby coming into contact with the melt portion 15 and cooling it. Thus, the arrangement of the second and third supply holes 51*a*, 51*b* in addition to the first supply hole 41 can increase the amount of water for cooling the melt portion 15 in contact with the gas 14, resulting in higher capability of cooling the melt portion 15.

The production method in this embodiment can cope with unevenness in the position of the melt portion 15 in contact with the gas 14. The actual amount of a melt poured into the casting mold cavity 5 from a ladle in a melt-pouring step is inevitably uneven (more or less) relative to a target amount. When the actual amount of a melt is more than the target amount, the melt portion 15 in contact with the gas 14 is shifted to the right side (on the side of a sprue 6). As a result, the melt portion 15 in contact with the gas 14 may not be able to be properly cooled only by water 44 supplied through the first supply hole 41. In the casting mold 50 having the second and third supply holes 51*a*, 51*b* on the right side of the first supply hole 41 in this embodiment, however, the melt portion 15 can be properly cooled by water 54 supplied through the second or third supply hole 51*a*, 51*b*, even if the melt portion 15 in contact with the gas 14 is shifted rightward.

Fifth Embodiment

The production method in the fifth embodiment of the present invention, which is more preferable than the third embodiment in preventing the collapse of a casting mold, will be explained referring to FIG. 7, which shows the cooling step of a melt 12.

Figure 7:
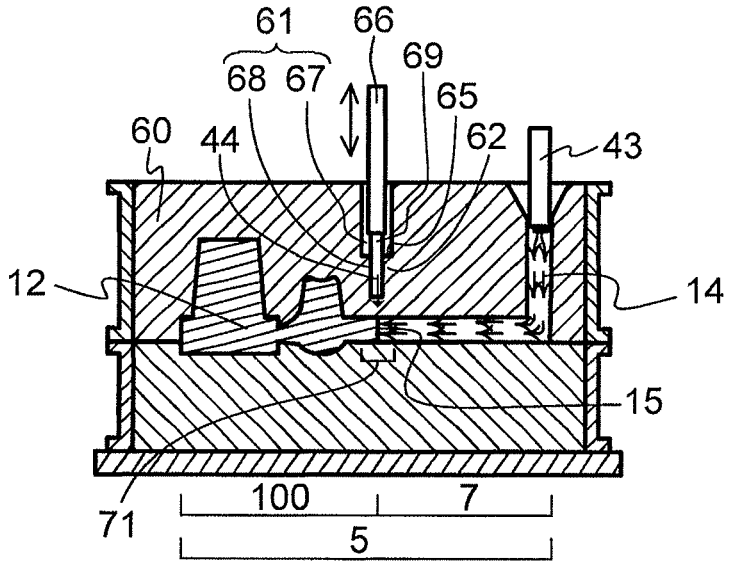
FIG. 7 is a schematic view showing a stage of the fifth production method of the present invention in which water is supplied to cool a melt.

As shown in FIG. 7, the basic structure of a casting mold 60 used in the fifth embodiment is the same as that of the casting mold in the third embodiment. The casting mold 60 comprises a supply hole 61, a bottomed hole directed to a gas-contacting portion 71. The supply hole 61 in this embodiment has a two-step wall as depicted, thereby having a large-diameter portion 67 open on an upper surface of the casting mold 60, and a small-diameter portion 68 under the large-diameter portion 67 and open on a bottom surface of the large-diameter portion 67. The small-diameter portion 68 is a bottomed hole in a portion 62 of the casting mold 60 between the bottom surface 65 of the large-diameter portion 67 and the gas-contacting portion 71. Water 44 is supplied to the supply hole 61 by a nozzle, etc. in this embodiment. The use of a syringe-type nozzle 66 having a needle 69 insertable into the small-diameter portion 68 makes it possible to surely supply water through the small-diameter portion 68, as shown in the figure.

The production method in this embodiment using the casting mold 60 having the supply hole 61 has basically the same steps as in the third embodiment, a pouring step to a cooling step. Because water 44 is supplied through the small-diameter portion 68 of the supply hole 61 in this embodiment as described above, the portion 62 of the casting mold 60 having the small-diameter portion 68 can be thicker than the portion 42 of the casting mold used in the third embodiment (see FIG. 5), thereby advantageously avoiding the collapse of the supply hole 61, for example, in handling, and in the pouring step and the charging step. Also, even when the syringe-shaped nozzle 66 insertable into the small-diameter portion 68 is not used, this embodiment has comparably high cooling capability to the third embodiment, because water 44 can be smoothly supplied through the large-diameter portion 67 above the small-diameter portion 68.

As shown in FIG. 7, the needle 69 of the vertically movable nozzle 66 can be inserted into the portion 62 of the casting mold 60 having no small-diameter portion 68, to a small-diameter portion 68 when starting the supply of water 44, resulting in a larger effect of preventing the collapse of the mold. In this case, a hole of the needle 69 may be regarded as a small-diameter portion 68. When cooling is conducted through a small-diameter portion 68 formed by the needle 69 after finishing the charging step of a melt 12 into a desired cavity 100, the small-diameter portion 68, a supply hole, need not be a bottomed hole, without considering the flow of the melt 12 through the runner 7 in the charging step. Namely, by inserting the needle 69 into the gas-contacting portion 71 to form a penetrating hole having a lower end open in the gas-contacting portion 71, water 44 supplied through the hole (small-diameter portion) 68 can directly cool the melt portion 15 in the gas-contacting portion 71.

A more preferred supply hole 61 in this embodiment comprises a large-diameter portion 67 and a small-diameter portion 68 both cylindrical and arranged coaxially as shown in FIG. 7, though not restricted to the depicted embodiment. For example, the large-diameter portion 67 and the small-diameter portion 68 may be arranged with their axes displaced horizontally or crossing each other, or at least one of the large-diameter portion 67 and the small-diameter portion 68 may be inclined.

Sixth Embodiment

The production method in the sixth embodiment of the present invention, which is more preferable than the third embodiment in cooling capability when a portion of the melt in contact with the gas is indirectly cooled by water, will be explained referring to FIG. 8, which shows the cooling step of a melt 12.

Figure 8:
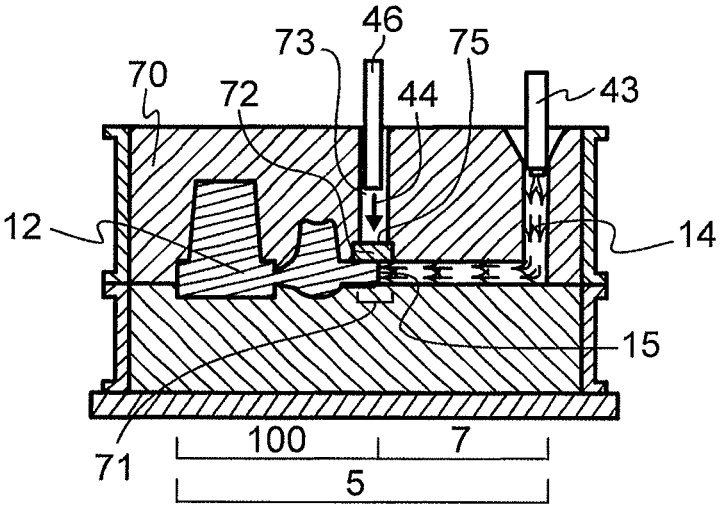
FIG. 8 is a schematic view showing a stage of the sixth production method of the present invention in which water is supplied to cool a melt.

As shown in FIG. 8, a casting mold 70 used in the sixth embodiment is the same as that in the third embodiment, except that a cooling member 72 having larger thermal conductivity than that of the casting mold 70 is disposed between a bottom surface 75 of a supply hole 73 (bottomed hole) directed to a gas-contacting portion 71 and the gas-contacting portion 71. In the casting mold 70 in this embodiment, the cooling member 72 is disposed in contact with a lower end of the supply hole 73, and an upper surface of the cooling member 72 constitutes a bottom surface 75 of the supply hole.

The production method in the sixth embodiment using the casting mold 70 has basically the same steps as in the third embodiment, a pouring step to a cooling step. When water 44 supplied through the supply hole 73 directed to the gas-contacting portion 71 comes into contact with an upper surface 75 of the cooling member 72 (bottom surface of the supply hole 73) heated by the melt 12 in the gas-contacting portion 71 as shown in the figure, water 44 is evaporated to cool the cooling member 72, thereby indirectly cooling the melt portion 15 in contact with the gas 14. Because the cooling member 72 has larger thermal conductivity than that of the casting mold 70, this embodiment has higher capability of cooling the melt portion 15 than the third embodiment in which part of the casting mold is indirectly cooled.

In this embodiment, a portion of the casting mold 70 may exist above and/or below the cooling member 72 disposed at a lower end of the supply hole 73. The cooling member 72 and a portion of the casting mold may exist between the supply hole 73 and the gas-contacting portion 71. Also, when the cooling member 72 is exposed to the runner 7, a bottom surface of the cooling member 72 preferably forms as little projection or recess as possible on an inner surface of the runner 7, lest that the flow of the melt 12 through the runner 7 by the gas 14 is hindered. Specifically, a bottom surface of the cooling member 72 disposed in the casting mold 70 is desirably substantially aligned with the inner surface of the runner 7.

The cooling member 72 is desirably made of a metal having high thermal conductivity, more desirably comprises the same components as in the melt 12 to avoid the inclusion of foreign matter. The cooling member 72 is not restricted to a block shape as depicted. For example, the cooling member may be a laminate of flat plates, granules arranged densely or dispersively in the casting mold 70, or a ring surrounding a cross section of the runner.

Seventh Embodiment

The production method in the seventh embodiment of the present invention, which is more preferable than the third embodiment, will be explained referring to FIG. 9, which shows the cooling step of a melt 12. The production method in this embodiment appears to be better than the third to sixth embodiments in cooling capability and the flowability of a melt in a runner.

Figure 9:
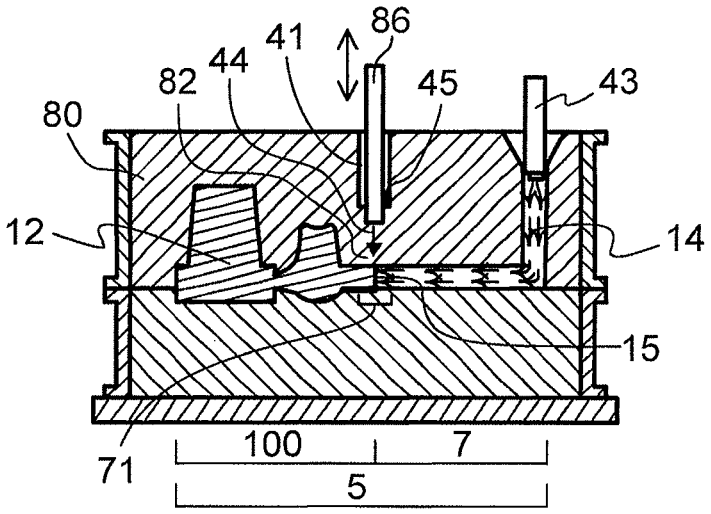
FIG. 9 is a schematic view showing a stage of the seventh production method of the present invention in which water is supplied to cool a melt.

As shown in FIG. 9, a casting mold 80 used in the seventh embodiment is the same as that in the third embodiment, except that a nozzle 86 inserted into a supply hole 41 for ejecting water from its lower end is vertically movable. With the nozzle 86 inserted into the supply hole 41 moving downward, its lower end portion pushes downward a portion 82 of the casting mold 80 between the supply hole 41 and the gas-contacting portion 71, to the melt portion 15 in the gas-contacting portion 71. Namely, the nozzle 86 in this embodiment not only ejects water 44 into the supply hole 41, but also pushes downward a portion 82 of the casting mold 80 between the supply hole 41 and the gas-contacting portion 71. By pushing the portion 82 of the casting mold 80 downward, good heat conduction is achieved between the melt portion 15 in contact with the gas 14 and the portion 82 of the casting mold 80, resulting in higher cooling capability. Incidentally, the nozzle 86 may not have a pushing function, by having a pushing member apart from the water-ejecting nozzle 86.

The production method in this embodiment using the casting mold 80 has basically the same steps as in the third embodiment, a pouring step to a cooling step. In the cooling step in this embodiment, the melt is solidified by cooling the melt portion 15 in contact with the gas 14 by water 44, while the portion 82 of the casting mold 80 between the bottom surface 45 of the supply hole (bottomed hole) 41 and the gas-contacting portion 71 is pushed to the melt portion 15.

While pushing the cooling member in the sixth embodiment disposed between the supply hole 41 and the gas-contacting portion 71 to a portion of the melt in contact with the gas, the melt may be solidified by cooling the melt portion 15 by water.

Because the supply hole 41 is a bottomed hole in this embodiment as described above, it does not hinder the flow of the melt 12 pushed by the gas 14 through the runner 7, so that the melt 12 is smoothly charged into the desired cavity portion 100. In addition, because the melt portion 15 in contact with the gas 14, which is pushed by the portion 82 of the casting mold 80 between the bottom surface 45 of the supply hole 41 and the gas-contacting portion 71, is cooled by water, improved heat conduction is achieved from the melt portion 15 to the portion 82 of the casting mold 80 or the cooling member, resulting in higher cooling capability, and thus accelerating the solidification of the melt portion 15.

The production methods in the third to seventh embodiments are combinations of the embodiment (2) in which a gas is supplied through a sprue, wile water is supplied through a different path (specifically, a supply hole formed at a different position from that of a sprue), and the embodiment (b) in which a melt portion in contact with the gas is indirectly cooled by water, among the embodiments (1), (2), (a) and (b). The eighth embodiment, a combination of the embodiment (2) and the embodiment (a) in which a melt portion in contact with the gas is directly cooled by water will be explained below.

Eighth Embodiment

Figure 10:
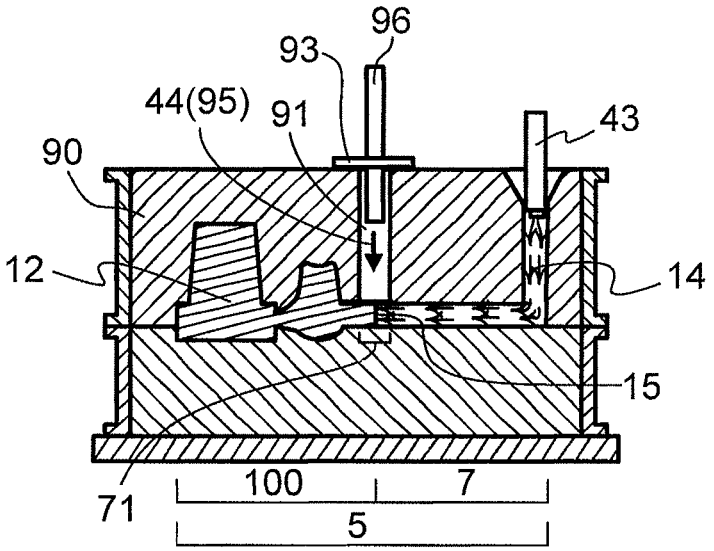
FIG. 10 is a schematic view showing a stage of the eighth production method of the present invention in which water is supplied to cool a melt.

The production method in the eighth embodiment of the present invention will be explained referring to FIG. 10, which shows the cooling step of a melt 12. As shown in FIG. 10, a casting mold 90 used in the eighth embodiment is the same as that in the third embodiment, except that the supply hole 91 is a penetrating hole. The supply hole 91, a penetrating hole, has an upper end open on an upper surface of the casting mold 90, and a lower end open in the gas-contacting portion 71.

The production method in this embodiment using such casting mold 90 is basically the same as those in the third to seventh embodiments, having a pouring step to a cooling step. In the cooling step in this embodiment, as shown in FIG. 10, water 44 supplied through the supply hole 91, a penetrating hole open in the gas-contacting portion 71, is brought into contact with the melt portion 15 in the gas-contacting portion 71 for direct cooling. Because of high cooling capability due to direct cooling by water 44 in this embodiment, the melt portion 15 in contact with the gas 14 is rapidly solidified.

Because the supply hole 91 (penetrating hole) has an opening in the gas-contacting portion (runner) 71, through which the melt 12 flows, the melt 12 pushed by the supplied gas 14 may enter the supply hole 91 through the above opening. In this case, the intrusion of the melt 12 can be prevented by decreasing a horizontal cross section area of the supply hole 91, but it is preferable to use a nozzle 96 capable of supplying water 44 and a gas 95 as shown in FIG. 10, like the nozzle 13 in the first and second embodiments. When supplying a gas 95, the nozzle 96 is desirably provided with a flange-shaped shutter plate 93 for closing an upper opening of the supply hole 91 to prevent gas leak.

When the casting mold has a nozzle 96 supplying water and a gas, a gas 95 at predetermined pressure is supplied from the nozzle 96 through the supply hole 91 at a predetermined flow rate, in the charging step of the melt 12 by the gas 14 supplied through the ejection device 43, and the pressures and flow rates of both gases supplied through the ejection device 43 and the nozzle 96 are properly adjusted to achieve a balanced pushing force to the melt 12, thereby preventing the melt 12 from intruding the supply hole 91, and the gases 14 and 95 from entering the melt 12.

EFFECTS OF THE INVENTION

In pressure-casting method according to the present invention, the poured melt can be easily kept in a cavity by cooling a portion of the melt in contact with the supplied gas by water to remove heat rapidly, thereby effectively shortening a production tact.

What is claimed is:

1. A method for producing a casting by pouring a metal melt by gravity into a gas-permeable casting mold having a cavity comprising at least a sprue, a runner and a product-forming cavity, comprising pouring a metal melt into a desired cavity portion including said product-forming cavity through said sprue, said melt being in a volume smaller than the volume of an entire cavity of said gas-permeable casting mold and substantially equal to the volume of said desired cavity portion;

supplying a gas to said desired cavity portion through said sprue before said desired cavity portion is filled with the poured melt, so that said melt fills said desired cavity portion; and cooling a portion of said melt in contact with the gas directly or indirectly by water supplied from outside said gas-permeable casting mold, simultaneously with, during or after supplying said gas, thereby solidifying said melt.

2. The method for producing a casting according to claim 1, wherein the melt is solidified by bringing water into contact with a portion of said melt in contact with the gas.

3. The method for producing a casting according to claim 1, wherein said water is supplied in the form of a mist-containing gas.

4. The method for producing a casting according to claim 1, wherein a hollow portion of said product-forming cavity spreads above its melt inlet.

5. The method for producing a casting according to claim 1, wherein said cavity of said gas-permeable casting mold comprises a feeder disposed between said product-forming cavity and said runner and constituting said desired cavity portion together with said product-forming cavity, a hollow portion of said feeder spreading above its melt inlet.

6. The method for producing a casting according to claim 1, wherein said water is supplied to said desired cavity portion comprising a portion of said melt in contact with the gas, through a supply hole formed at a different position from that of said sprue.

7. The method for producing a casting according to claim 6, wherein said supply hole is a bottomed hole.

8. The method for producing a casting according to claim 7, wherein a bottom surface of said supply hole opposes a cavity comprising a portion of said melt in contact with the gas, via part of said gas-permeable casting mold.

9. The method for producing a casting according to claim 8, wherein said melt is solidified by cooling with said water, while part of said gas-permeable casting mold or said cooling member between the bottom surface of said supply hole and a cavity portion comprising a portion of said melt in contact with the gas is pushed to a portion of said melt in contact with the gas.

10. The method for producing a casting according to claim 7, wherein a cooling member exists between the bottom surface of said supply hole and a cavity comprising a portion of said melt in contact with the gas.

* * * * *